US007909105B2

(12) United States Patent
Borak, Jr. et al.

(10) Patent No.: US 7,909,105 B2
(45) Date of Patent: Mar. 22, 2011

(54) INDEPENDENT WELLHEAD DRILLING ADAPTER

(75) Inventors: Eugene A. Borak, Jr., Cypress, TX (US); Anton J. Dach, Jr., Trinity, TX (US); Vanson Huynh, Houston, TX (US)

(73) Assignee: VetcoGray Inc., Houston, TX (US)

( * ) Notice: Subject to any disclaimer, the term of this patent is extended or adjusted under 35 U.S.C. 154(b) by 32 days.

(21) Appl. No.: 12/167,959

(22) Filed: Jul. 3, 2008

(65) Prior Publication Data

US 2009/0032265 A1 Feb. 5, 2009

Related U.S. Application Data

(60) Provisional application No. 60/948,306, filed on Jul. 6, 2007.

(51) Int. Cl.
*E21B 33/03* (2006.01)

(52) U.S. Cl. ..... 166/379; 166/85.1

(58) Field of Classification Search ..... 166/75.11, 166/85.1, 85.3, 85.4, 379; 285/123.1; 251/1.1, 251/1.2; 277/324
See application file for complete search history.

(56) References Cited

U.S. PATENT DOCUMENTS

| | | | | |
|---|---|---|---|---|
| 3,759,453 | A * | 9/1973 | Johnson | 241/207 |
| 4,690,220 | A * | 9/1987 | Braddick | 166/382 |
| 6,092,596 | A * | 7/2000 | Van Bilderbeek | 166/89.1 |
| 2005/0092496 | A1 * | 5/2005 | Duhn et al. | 166/308.2 |

OTHER PUBLICATIONS

"Specification for Independent Wellhead Equipment", APSI Specification 11IW, First Edition, Jun. 2000, pp. 1-4, 15-17.
"Quick Lock Drilling Flange", www.wellheadinc., pp. 1-3, Jun. 29, 2007.

* cited by examiner

*Primary Examiner* — Kenneth Thompson
(74) *Attorney, Agent, or Firm* — Bracewell & Giuliani

(57) ABSTRACT

An assembly for connecting a drilling adapter to a wellhead comprising external threads on an end portion thereof.

12 Claims, 2 Drawing Sheets

INDEPENDENT WELLHEAD DRILLING ADAPTER

CROSS REFERENCE TO RELATED APPLICATIONS

The present application claims the benefit of the filing date of U.S. provisional application Ser. No. 60/948,306, filed on Jul. 6, 2007, the disclosure of which is incorporated herein by reference.

FIELD OF THE INVENTION

This invention relates in general to oil and gas well drilling, and, in particular to an adapter for connecting a blowout preventer to an independent wellhead.

BACKGROUND

Conventional adaptors for coupling devices such as, for example, a blow out preventer ("BOP") to a wellhead typically require a threaded connection. As a result, such adaptors require rotation of the BOP relative to the wellhead during installation. This connection requiring rotation is time consuming and requires a large well bay to allow the BOP to rotate and connect to such a threaded connector. Since many new oil rigs have small well bays this create logistical problems. Other conventional adaptors for coupling devices to a wellhead require that the wellhead threads must be non-standard thereby adding cost and complexity. The present exemplary embodiments are directed to overcoming some of the limitations of conventional adaptors used to couple devices to wellheads.

DETAILED DESCRIPTION OF THE INVENTION

Figure 1:
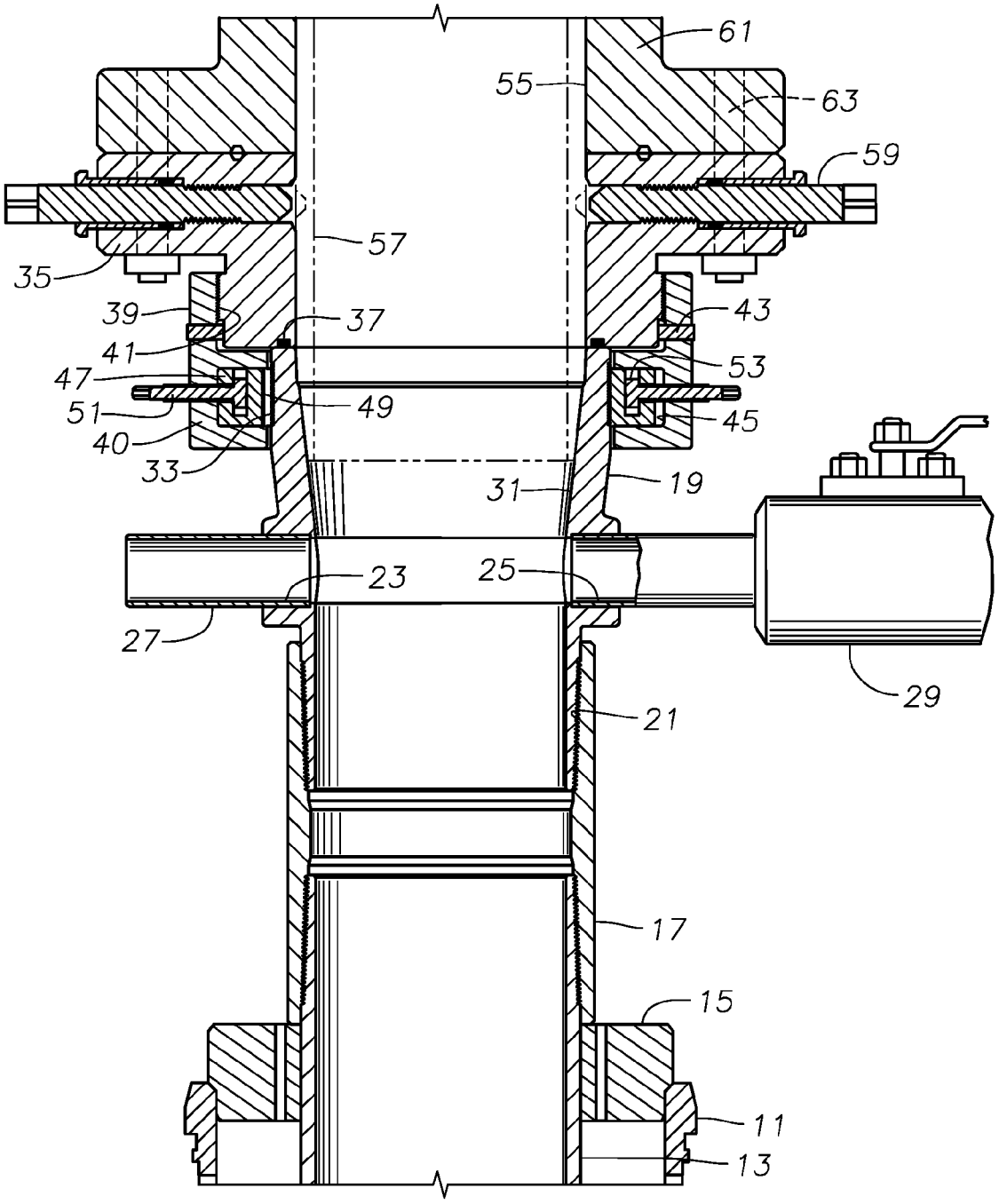
FIG. 1 is a sectional view illustrating an adapter connecting a blowout preventer to an independent wellhead, in an exemplary embodiment of the present technique.

In the drawings and description that follows, like parts are marked throughout the specification and drawings with the same reference numerals, respectively. The drawings are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. The various characteristics mentioned above, as well as other features and characteristics described in more detail below, will be readily apparent to those skilled in the art upon reading the following detailed description of the embodiments, and by referring to the accompanying drawings.

Referring to FIG. 1, a first casing 11 extends into the well for a first distance and has an upper end landing ring illustrated in FIG. 1. A second casing 13 extends into the well to a second depth and has an upper end with a landing ring 15 that lands on the upper end of first casing landing ring 11. The upper end of casing 13 is threaded and in this example is connected to a casing collar 17. Casing collar 17 has internal threads on its upper end.

A wellhead 19 has a lower set of external threads 21 that secure to the internal threads in casing collar 17. Wellhead 19 is preferably a type referred to as an "independent wellhead", which has specifications dictated by the American Petroleum Institute. Currently, the specifications are governed by API Specification 11IW, June, 2000 "Specification for Independent Wellhead Equipment". Wellhead 19 may be a casing head or it may be a tubing head. Lower threads 21 may be external or internal and still fall within the specification. Wellhead 19 has one or more outlets 23, extending through its sidewall. Outlet 23 is shown connected to a nipple 27 for connection to additional equipment. Outlet 25 is shown connected to a valve 29. Wellhead 19 has an interior bowl or profile 31 extending above outlets 23, 25. In this embodiment, profile 31 is a conical taper, however other configurations for profile 31 are allowed within the API specification. Wellhead 19 has an upper thread set 33 on its exterior extending downward from its rim. Upper thread set 33 is also governed by the API specification and comprises specified API pipe threads.

In this embodiment, a drilling adapter 35 mounts to wellhead 19 during drilling. Adapter 35 lands on the rim or upper end of wellhead 19. A seal 37 on the lower side of adapter 35 seals against the upper end of wellhead 19. Adapter 35 has a connector ring 39 that is secured to it for connecting adapter 35 to wellhead 19. In this example, connector ring 39 is secured by threads 41 to a threaded portion on the exterior of adapter 35. Lock pins 43 extend through the sidewall of connector ring 39 into engagement with vertical grooves formed below threads 41 to prevent lock ring 39 from rotating relative to adapter 35. Connector ring 39 could be connected to adapter 35 in manners other than by threads, if desired.

Connector ring 39 has a lower portion 40 that extends below adapter 35. Lower portion 40 extends inward under the lower end of adapter 35 and surrounds wellhead threads 33. Lower portion 40 has an internal annular recess 45 that has an open side facing wellhead threads 33. A plurality of segments 47 are carried in annular recess 45. Each segment 47 is arcuate section of a ring and has a portion of a thread set 49 on its inner face. Thread set 49 is formed to match threads 33 of wellhead 19. Each segment 47 is movable radially from the outer position shown on the left side of FIG. 1 to the inner position shown on the right side. In the inner position, segment threads 49 will be in engagement with wellhead threads 33. In an exemplary embodiment, the profile of the threads of the segments 47 are configured relative to the threads on the wellhead 19 such that, as the threads of the segments 47 are tightened against the threads on the wellhead 19, the connector ring 39 is pulled down, the seal 37 engages and thereby seals against the top of the wellhead. When in the inner position, the sides of segments 47 abut each other and the thread sets 49 define a continuous set of threads that mate with wellhead threads 33. Segments 47 may be manufactured by first cutting a set of threads on the inner diameter of a ring, then cutting the ring into individual segments. In the outer position, segment threads 49 will be spaced radially outward from wellhead threads 33.

The mechanism to move each segment 47 radially inward and outward in this embodiment comprises a screw 51 that extends through a threaded hole in connector ring 39 radially outward from recess 45. Each screw 51 has an inner end 53 that engages a recess within one of the segments 47 and is rotatable relative to the segment 47. Preferably each screw 51 has a polygonal outer end for receiving a wrench to rotate screw 51.

Adapter 35 also has a bore 55 that aligns with the upper end of wellhead profile 31. Prior to drilling through wellhead 19, the operator installs a drilling or wear bushing 57, shown by dotted lines. Wear bushing 57 slides down over profile 31 to protect profile 31 from damage during drilling. Wear bushing 57 has an upper end that is releasably retained with adapter 35. In this example, the retainer comprises a plurality of radially extending screws 59 extending through adapter 35. Each screw 59 has a pointed end that engages an annular recess on the exterior of wear bushing 57. Screws 59 extend radially through threaded holes in adapter 35.

A blowout preventer 61 mounts on top of adapter 35. Blowout preventer 61 may be a variety of types and is shown by dotted lines. In this example, blowout preventer 61 secures to a flange portion of adapter 35 by means of bolts 63.

In operation, the operator will initially drill the well and install casings 11 and/or 13. The operator then installs wellhead 19 on casing 13 at the rig floor and run in the wellhead 19, collar 17, and landing ring 15 as illustrated in FIG. 1. The operator places adapter 35 on wellhead 19 and rotates screws 51 to cause segments 47 to move into mating engagement with wellhead threads 33. There is no need to rotate adapter 35 relative to wellhead 19. The operator inserts well bushing 57 and rotates screws 59 inward to secure wear bushing 57. Adapter 35 may have previously connected to blowout preventer 61 prior to landing adapter 35 on wellhead 19. The operator drills through wellhead 19 to the total depth.

Figure 2:
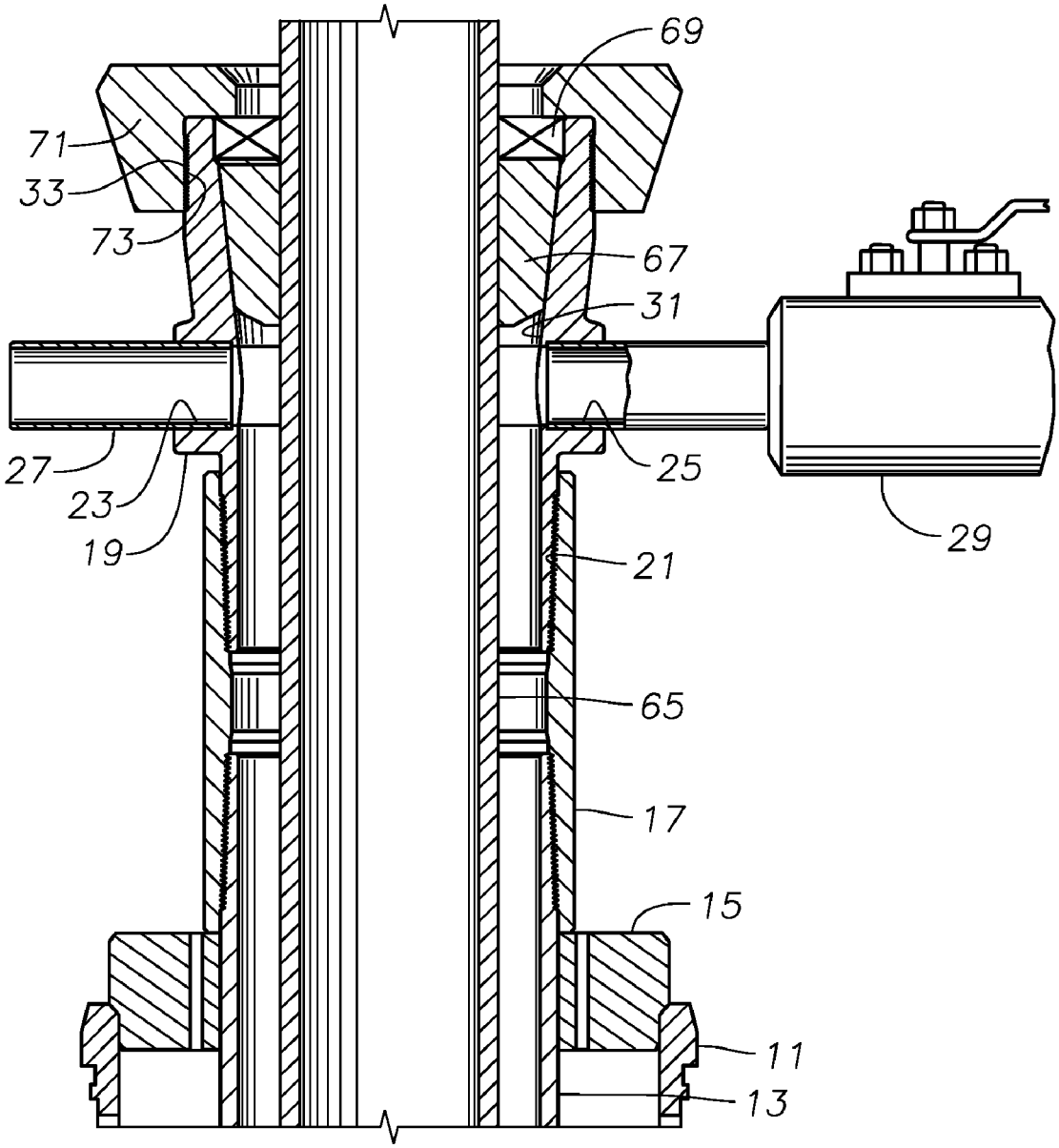
FIG. 2 is a view of the wellhead of FIG. 1, shown with the adapter and the blowout preventer removed and casing installed, in an exemplary embodiment of the present technique.

The operator removes wear bushing 57 and in this example, installs a string of casing 65, shown in FIG. 2. Casing 65 may be run through BOP 61 (FIG. 1). Casing 65 is cemented in place and a hanger mechanism 67 supports casing 65. In this example, hanger 67 comprises tapered slips that engage profile 31 in wellhead 19. BOP 61, adapter 35 and connector ring 39 (FIG. 1) are removed as a unit and reused for drilling another well. The operator installs a packoff 69 between an upper portion of wellhead profile 31 and casing 65. A top connector 71 has an inner portion that fits over packoff 69 to retain packoff 69 and to deform it into sealing engagement with wellhead profile 31. Top connector 71 has a lower portion with internal threads 73 that engage upper threads 33 on wellhead 19.

Other types of completions after drilling are available, but these completions would also utilize wellhead upper threads 33. Furthermore, as mentioned, rather than supporting casing, wellhead 19 could support a string of tubing.

The present exemplary embodiments provide an assembly for connecting a component to a wellhead comprising external threads on an end portion thereof in which the assembly may be connected to the threaded portion of the wellhead without having to rotate the component.

It is understood that variations may be made in the above without departing from the scope of the invention. While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

The invention claimed is:

1. A wellhead assembly, comprising:

a wellhead having an external threaded end portion;

a drilling adapter that lands on the end portion of the wellhead;

a connection ring mounted to the drilling adapter and encircling the end portion of the wellhead;

a plurality of segments carried by and circumferentially positioned around the connection ring, each segment having an internal threaded portion and being movable between inner and outer positions;

while the segments are in the outer position, the adapter being able to be lowered onto the wellhead with the segments out of engagement with the end portion of the wellhead; and a plurality of screws, each operably coupled to the connection ring and a corresponding one of the segments for moving the segments to the inner position with the internal threaded portions of the segments into engagement with the external threaded end portion of the wellhead.

2. The assembly of claim 1, wherein the connection ring has an internal annular recess; and wherein the segments are received within the recess.

3. The assembly of claim 1, further comprising a wear bushing that fits within a bore of the drilling adapter.

4. The assembly of claim 3, further comprising:

a blow out preventer coupled to an upper end portion of the drilling adapter.

5. An assembly for connecting a blow out preventer to a wellhead having an external threaded end portion, comprising:

a drilling adapter adapted to be coupled to an end of the blow out preventer;

a connection ring coupled to the drilling adapter adapted to receive the end portion of the wellhead;

a plurality of segments carried by and circumferentially positioned around the connection ring, each segment having an inner end containing an internal threaded portion and being movable between inner and outer positions;

while the segments are in the outer position, the adapter being able to be lowered onto the wellhead with the segments out of engagement with the end portion of the wellhead; and a plurality of screws secured to an outer wall of the connection ring, each screw being coupled to one of the segments for moving the segments an inward radial direction to the inner position with the internal threaded portions in engagement with the external threaded end portion of the wellhead.

6. The assembly of claim 5, wherein the connection ring defines an internal annular recess; and wherein the segments are received within the recess.

7. A method of connecting a drilling adapter to a wellhead having an external threaded end portion, comprising:

mounting a connector assembly to the drilling adapter, the connector assembly comprising a plurality of segments, each segment having an inward facing threaded portion and being movable between inner and outer positions;

while the segments are in the outer position, landing the adapter on the end portion of the wellhead and positioning the connector assembly around the end portion of the wellhead, the segments being out of engagement with the threaded end portion of the wellhead while in the outer position; and moving the segments to the inner position and causing the inward facing threaded portions to engage the external threaded end portion of the wellhead.

8. The method of claim 7, wherein moving the segments to the inner position comprises moving the segments in an inward radial direction.

9. The method of claim 7, further wherein the segments are at corresponding circumferentially spaced locations.

10. The method of claim 7, further comprising:

inserting a wear bushing into the drilling adapter; and coupling the wear bushing to the drilling adapter.

11. The method of claim 7, further comprising:

coupling a blow out preventer to the drilling adapter;

lowering drill pipe through the blow out preventer, the drill pipe and the wellhead and drilling the well;

installing casing in the well;

moving the segments to the outer position and removing the drilling adapter and blowout preventer;

installing a packoff in the wellhead housing; and providing a top connector ring with an internal threaded portion, placing the top connector ring on the end portion of the wellhead, and rotating the top connector ring to secure the internal threaded portion of the top connector ring to the external threaded end portion of the wellhead.

12. A method of drilling a well, comprising:

forming the well to a first depth and installing a string of outer casing;

connecting a wellhead to the string of outer casing, the wellhead having an external threaded end portion;

mounting a connection ring to a drilling adapter, the connection ring containing a plurality of segments spaced circumferentially around the connection ring, each of the segments being movable between outer and inner positions and having an internal threaded portion, each of the segments being in engagement with a screw extending through an outer wall of the connection ring;

with the segments in the outer position, landing the adapter on the wellhead with the connection ring encircling the threaded end portion of the wellhead and the internal threaded portions of the segments out of engagement with the threaded end portion of the wellhead;

rotating the screws to move the segments in an inward radial direction to the inner position with the internal threaded portions of the segments in engagement with the threaded end portion of the wellhead;

placing a wear bushing in a bore of the adapter and mounting a blow out preventer to an upper end of the adapter;

lowering drill pipe through the blow out preventer, the adapter and the wellhead and drilling the well to a total depth;

installing a string of production casing within the outer casing;

rotating the screws to move the segments to the outer position and removing the adapter;

installing a packoff in the bore of the wellhead; and placing a top connector ring with an internal threaded portion on the wellhead over the packoff and rotating the top connector ring to secure internal threaded portion of the top connector ring to the threaded end portion of the wellhead.

* * * * *